US006857471B2

(12) United States Patent
Thangarasu et al.

(10) Patent No.: US 6,857,471 B2
(45) Date of Patent: Feb. 22, 2005

(54) SPLIT BASE PLATE ASSEMBLY FOR MULTIPLE COMPLETION WELLHEADS

(75) Inventors: Appavoo Thangarasu, Singapore (SG); Bernard Ong, Singapore (SG); Kevin Kok Sum Lim, Singapore (SG); Bimo Wiratnanto, Klaten (ID); Joseph Shu Yian Liew, Singapore (SG)

(73) Assignee: FMC Technologies, Inc., Chicago, IL (US)

( * ) Notice: Subject to any disclaimer, the term of this patent is extended or adjusted under 35 U.S.C. 154(b) by 23 days.

(21) Appl. No.: 10/316,508

(22) Filed: Dec. 11, 2002

(65) Prior Publication Data

US 2003/0127221 A1 Jul. 10, 2003

Related U.S. Application Data

(60) Provisional application No. 60/339,660, filed on Dec. 12, 2001.

(51) Int. Cl.[7] ..... E21B 19/00

(52) U.S. Cl. ..... 166/75.14; 166/97.5; 277/188 A

(58) Field of Search ..... 166/89.2, 84.1, 166/75.14, 97.5, 179, 189; 277/188 A

(56) References Cited

U.S. PATENT DOCUMENTS 2,794,505 A * 6/1957 Allen ..... 166/97.5
3,011,552 A 12/1961 Rhodes et al.
3,025,083 A * 3/1962 Lebeaux ..... 285/18
3,118,690 A 1/1964 Watts et al.
3,177,013 A * 4/1965 Rector ..... 285/123.2
3,251,611 A 5/1966 Haeber et al.
3,330,354 A 7/1967 Chamblee
4,098,334 A 7/1978 Crowe
4,681,173 A * 7/1987 Disher et al. ..... 175/7
5,732,772 A * 3/1998 Borak et al. ..... 166/75.14
5,813,468 A 9/1998 Borak, Jr.
6,543,553 B2 * 4/2003 Bergeron ..... 175/61

* cited by examiner

*Primary Examiner*—Frank Tsay
(74) *Attorney, Agent, or Firm*—Henry C. Query, Jr.

(57) ABSTRACT

A base plate assembly for supporting a number of tubular strings within a tubular housing comprises two base plate portions which when secured together are adapted to be supported on an upper end of the tubular housing. Each base plate portion comprises a top plate which includes an end face and a number of semicircular openings that extend from the end face. Thus, when the base plate portions are secured together, the semicircular openings align to form a number of circular bores which are each adapted to receive a corresponding tubular string. Also, the base plate portions may be disconnected and removed from the tubular housing after the tubular strings are secured in position.

20 Claims, 5 Drawing Sheets

FIG. 1
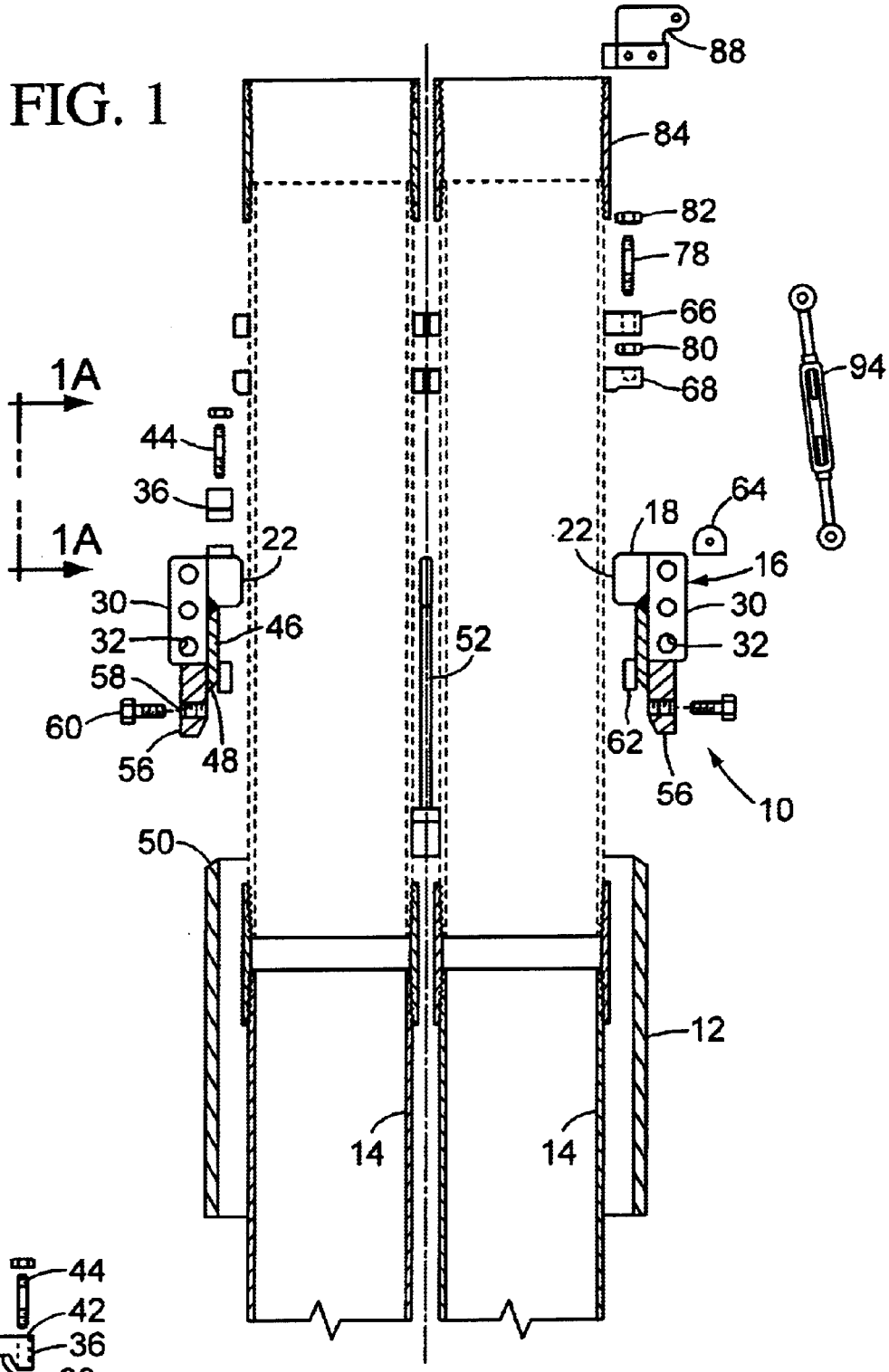
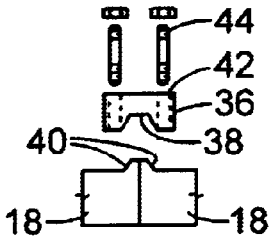
FIG. 1A

SPLIT BASE PLATE ASSEMBLY FOR MULTIPLE COMPLETION WELLHEADS

BACKGROUND OF THE INVENTION

The present invention is directed to a base plate assembly for supporting a number of casing strings within a conductor pipe of a multiple completion wellhead. More particularly, the invention is directed to a base plate assembly which comprises two base plate portions that can be disconnected and removed from the conductor pipe once the casing strings have been secured in position.

Base plates are commonly employed in multiple completion wellheads to facilitate the installation of two or more casing strings within an outer conductor pipe or housing. The base plate, which includes a casing bore for each casing string, is typically welded or otherwise permanently attached to the top of the conductor pipe. Each casing string is successively run in through its corresponding casing bore and supported by the base plate until all the casing strings have been installed. The casing strings are then usually cemented into position within the conductor pipe. After the casing strings are cemented into position, the base plate normally does not serve any further purpose in the multiple completion wellhead.

Since the base plate is typically permanently attached to the conductor pipe, it normally cannot be removed after the casing strings are cemented into position. Therefore, the base plate complicates the construction and increases the cost of the multiple completion wellhead. In addition, the base plate cannot be reused on other multiple completion wellheads.

SUMMARY OF THE INVENTION

In accordance with the present invention, these and other limitations in the prior art are addressed by providing a base plate assembly for supporting a number of tubular strings within a tubular housing. The base plate assembly comprises two base plate portions which when secured together are adapted to be supported on an upper end of the tubular housing, and means for releasably securing the base plate portions together. Each base plate portion comprises a top plate which includes an end face and a number of semicircular openings that extend from the end face. Thus, when the base plate portions are secured together, the semicircular openings align to form a number of circular bores which are each adapted to receive a corresponding tubular string. Also, the base plate portions may be disconnected and removed from the tubular housing after the tubular strings are secured in position.

Thus, the base plate assembly of the present invention may be used to install and support a number of tubular strings within a tubular housing. In addition, once the tubular strings are secured within the tubular housing, such as by cementing, the base plate portions can be easily and conveniently disconnected and removed from the tubular housing. Thus, the base plate assembly need not be a permanent part of the tubular housing. Accordingly, the construction of the tubular housing can be simplified and its cost to manufacture consequently reduced. In addition, the base plate assembly may be reused repeatedly. Therefore, the need to provide a base plate assembly for each of a number of tubular housings is eliminated.

These and other objects and advantages of the present invention will be made apparent from the following detailed description, with reference to the accompanying drawings.

BRIEF DESCRIPTION OF THE DRAWINGS

FIG. 1 is a partially exploded cross sectional view of the base plate assembly of the present invention shown in conjunction with a conductor pipe and two casing strings;

FIG. 1A is view of a portion of the base plate assembly taken along line 1A—1A of FIG. 1;

DETAILED DESCRIPTION OF THE PREFERRED EMBODIMENTS

The base plate assembly of the present invention may be used to facilitate the installation of a number of tubular strings within an outer tubular housing that is located at the upper end of a well bore. Due to its unique construction, the base plate assembly can be mounted on the tubular housing prior to the installation of the tubular strings, and then quickly and easily removed from the tubular housing once the tubular strings have been secured into position, such as by cementing. Accordingly, it may be seen that the base plate assembly may be used to install a variety of tubular strings. However, for purposes of simplicity, the base plate assembly will be described herein in conjunction with a multiple completion wellhead which comprises a number of casing strings that are supported within a conductor pipe or housing.

Figure 2:
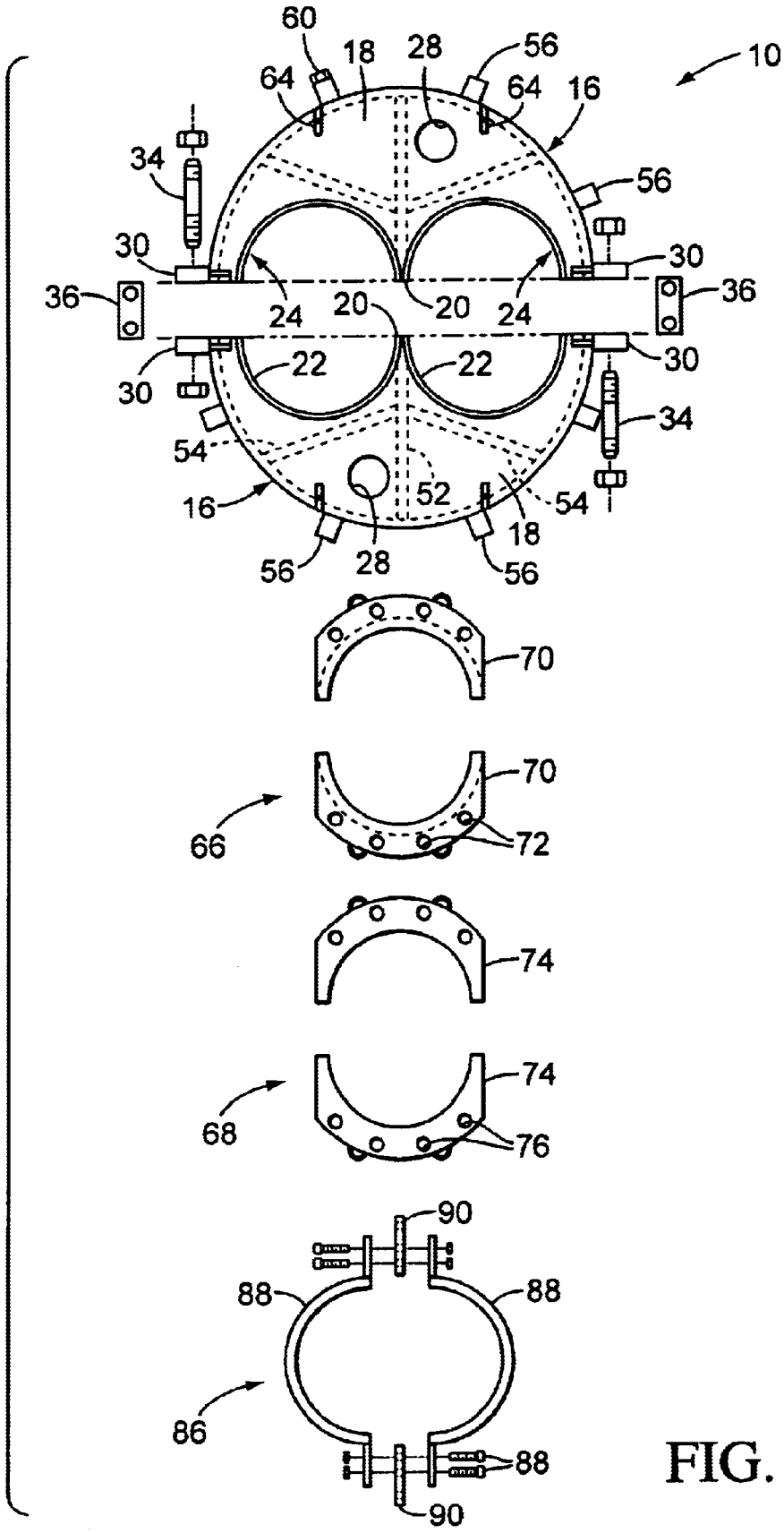
FIG. 2 is an exploded top view of the base plate assembly of FIG. 1.
Figure 3:
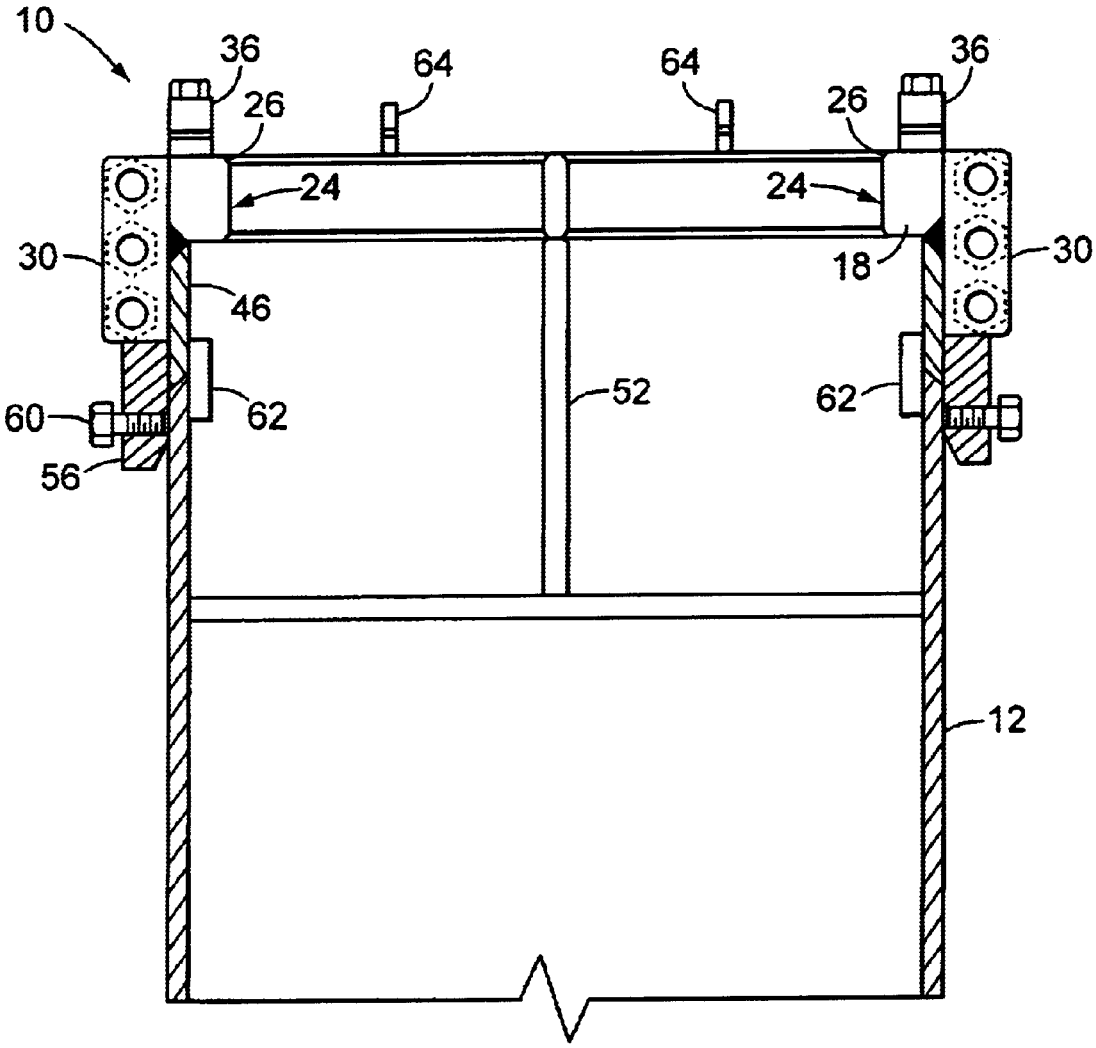
FIG. 3 is a cross sectional view of the base plate assembly of FIG. 1 shown installed on the conductor pipe.

Referring to FIGS. 1 through 3, the base plate assembly of the present invention, which is indicated generally by reference number 10, is designed to be removably connected to the top of a conductor pipe 12 in order to provide at least a temporary support for a number of casing strings 14 during installation of the casing strings within the conductor pipe. Accordingly, the base plate assembly 10 includes preferably two matching base plate portions 16 which are releasably secured together in a manner which will be described below. Each base plate portion 16 includes a top plate 18 having an end face 20 from which a number of semi-circular openings 22 extend. When the base plate portions 16 are secured together, the openings 22 align to form a number of circular casing bores 24 which have a predetermined center-to-center spacing. In addition, each casing bore 24 preferably comprises a bowl profile 26 which is formed in the top plates 18 near the upper end of the casing bore. Thus, when the base plate assembly 10 is connected to the conductor pipe 12, a casing string 14 may be run through and supported in each casing bore 24. In addition, one or both of the top plates 18 may include a number of flow ports 28 through which cement may be conveyed in order to cement the casing strings 14 within the conductor pipe 12.

The base plate assembly 10 also includes suitable means for releasably securing the base plate portions 16 together so that the base plate assembly 10 can be conveniently mounted to and removed from the conductor pipe 12 prior to and after the installation of the casing strings 14, respectively. In the illustrative embodiment of the invention shown in the drawings, for example, each base plate portion 16 comprises two connecting ears 30 which are attached by welding or other appropriate means to the top plate 18 on opposite sides of the end face 20. The connecting ears 30 each include at least one hole 32 which is aligned with a corresponding hole in the opposing connecting ear when the base plate portions 16 are positioned together, as shown in FIG. 2. A stud and nut assembly 34 or similar fastening means is received in each pair of aligned holes 32 to thereby secure the base plate portions 16 together.

Instead of or in addition to the securing means just described, the base plate assembly 10 may comprise a pair of alignment blocks 36 for releasably securing the base plate portions 16 together. The alignment blocks 36 also ensure that a close fit is achieved between the base plate portions 16. As shown most clearly in FIG. 1A, each alignment block 36 comprises a trapezoidal recess 38 which engages a pair of opposing tapered projections 40 which are each formed on or affixed to a portion of the top plate 18 that adjoins the adjacent top plate. Each alignment block 36 includes a number of through holes 42 which align with corresponding threaded holes in the top plate 18 (not shown). A bolt 44 or similar means is threaded through each hole 42 and into the corresponding threaded hole to thereby secure the alignment blocks 36 to the top plates 18. In addition, as the bolts 44 are tightened, the alignment blocks 36 are drawn down onto the tapered projections 40; and as the alignment blocks are drawn down, the tapered sides of the trapezoidal recesses 38 react against the tapered projections and thereby force the base plate portions 16 securely together.

Although not required, each base plate portion 16 may also include a semi-cylindrical pipe section 46 to enhance the structural strength of the base plate assembly 10. Each pipe section 46 is attached such as by welding to a corresponding top plate 18. In addition, the pipe sections 46 ideally comprise a diameter which is approximately the same as the diameter of the conductor pipe 12, and the bottom end 48 of each pipe section is optimally machined or otherwise prepared to match the top end 50 of the conductor pipe 12. Thus, when the base plate assembly 10 is mounted on the conductor pipe 12, the pipe sections 46 will land on the top end 50 of the conductor pipe.

Each base plate portion 16 may optionally also comprise a number of stiffening ribs to further increase the strength of the base plate assembly 10. For example, each base plate portion 16 may include a medial rib 52 which depends from the underside of the top plate 18 and extends radially between the pipe section 46 and a central portion of the end face 20. In addition, each base plate portion 16 may include one or more lateral ribs 54 which each depend from the underside of the top plate 18 and extend between the medial rib 52 and the pipe section 46. The ribs 52, 54 may be attached to their corresponding top plates 18 by any suitable means, such as welding.

The base plate assembly 10 ideally also includes a number of alignment guides 56 which are attached such as by welding to either the top plates 18 or, as shown in the Figures, the outer diameter of the pipe sections 46. The alignment guides 56 are positioned peripherally around the conductor pipe 12 and aid in aligning the base plate assembly 10 on the conductor pipe. At least some of the alignment guides 56 may include a radially extending threaded hole 58 which is adapted to receive a corresponding centralizing bolt 60. The bolts 60 serve to further align the base plate assembly 10 on the conductor pipe 12 and to help secure the base plate assembly to the conductor pipe.

The alignment of the base plate assembly 10 on the conductor pipe 12 may be improved by providing each base plate portion 16 with a number of centralizing ribs 62. The centralizing ribs 62 are attached such as by welding to either the top plates 18 or, as shown in the Figures, the inner diameter of the pipe sections 46. As shown in FIG. 3, the centralizing ribs 62 extend downwardly across the junction between the pipe sections 46 and the conductor pipe 12 and engage the inner diameter of the conductor pipe. In this manner, the conductor pipe 12 is sandwiched between the centralizing ribs 62 and the alignment guides 56, and the base plate assembly 10 is therefore securely retained in proper alignment on the conductor pipe.

The base plate assembly 10 preferably also includes a number of pad eyes 64 to facilitate lifting of the base plate assembly into position on the conductor pipe 12. As best seen in FIG. 2, ideally two pad eyes 64 are attached to each base plate portion 16, such as by welding. The pad eyes 64 may also be used to secure the casing strings 14 to the base plate assembly 10, as will be discussed below.

Prior to installation of the base plate assembly 10, the conductor pipe 12 is run or driven into the well bore until refusal. The conductor pipe 12 is then cut using either a flame torch or a mechanical cutter to a predetermined elevation, and the top end 50 is prepared as required to match the bottom end 48 of the pipe sections 46. The base plate portions 16 are then secured together as described above, and the base plate assembly 10 is picked up and landed on the conductor pipe 12, as shown in FIG. 3. If necessary, the base plate assembly 10 is centered on the conductor pipe using the centralizing screws 60 in the alignment guides 56. The base plate assembly 10 may be further secured to the conductor pipe 12 with short tacks of welding.

Once the base plate assembly 10 is mounted on the conductor pipe 12, the first casing string 14 may be run through an available casing bore 24 to the required depth. Prior to running the last joint of the casing string 14, however, a support ring assembly is connected to the casing string. Referring again to FIGS. 1 and 2, the support ring assembly comprises a lower split support ring 66 which is connected to an upper split support ring 68. The lower split support ring 66 comprises two ring halves 70 which are secured together by conventional means (not shown), and a number of threaded blind holes 72. The upper split support ring 68 similarly comprises two ring halves 74 which are secured together by known means (not shown), and a number of through bores 76 which align with the blind holes 72 in the lower split support ring 66.

Figure 4:
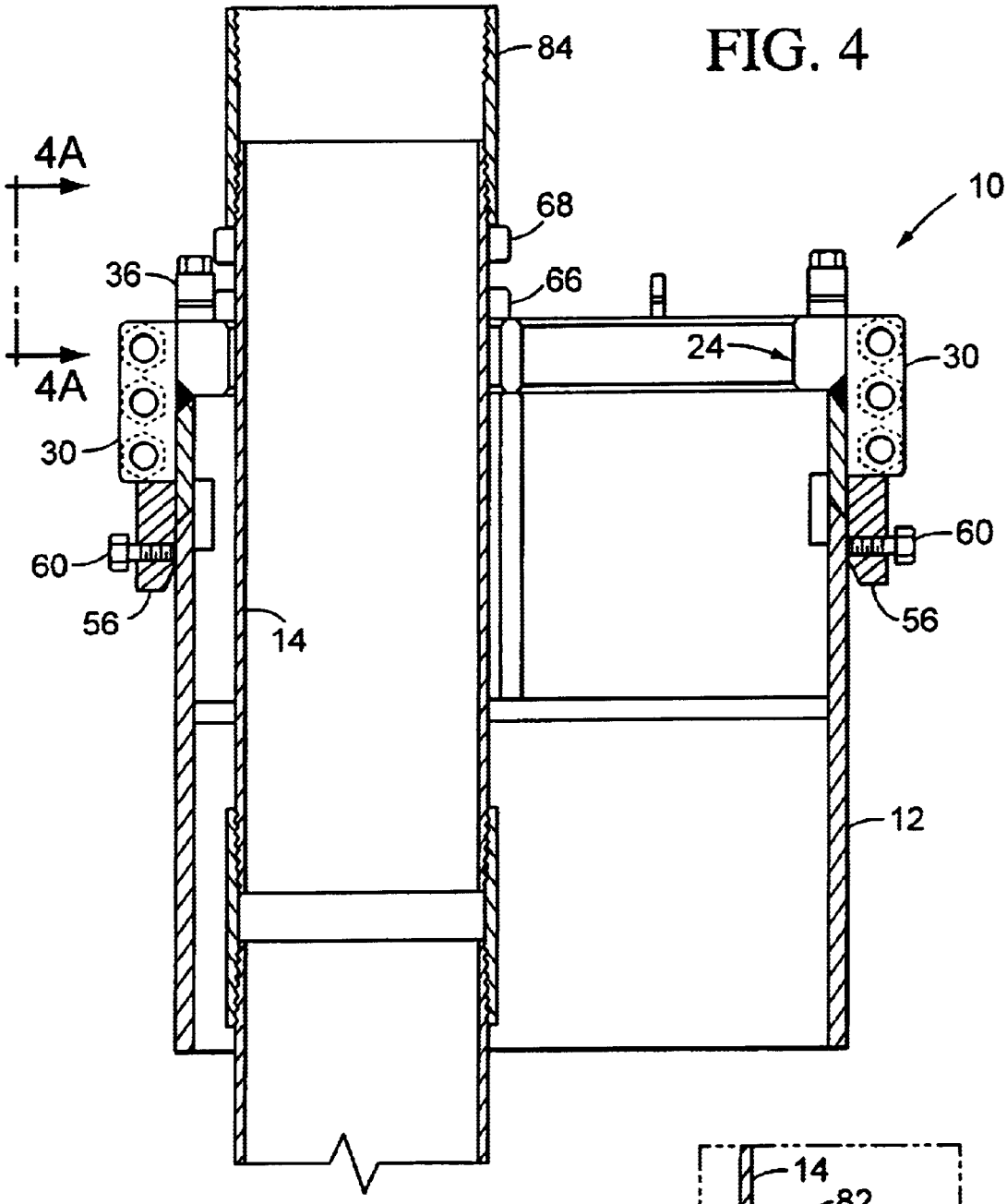
FIG. 4 is a cross sectional view of the base plate assembly of FIG. 3 showing a single casing string supported in the conductor pipe.
Figure 4A:
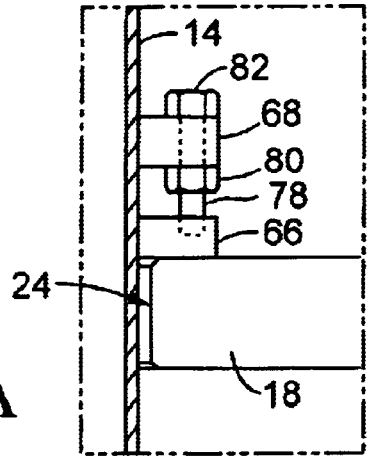
FIG. 4A is a view of a portion of the base plate assembly taken along line 4A—4A of FIG. 4.

Referring also to FIGS. 4 and 4A, the support ring assembly is connected to the casing string 14 by first loosely securing the lower split support ring 66 around the casing string. The lower split support ring 66 is allowed to land in the bowl profile 26 of the casing bore 24 which is formed in the top plates 18. A stud 78 is then screwed into each blind hole 72 in the lower split support ring 66, and a nut 80 is threaded approximately half way onto each stud. The upper split support ring 68 is then loosely secured around the casing string 14 above the lower split support ring 66. The upper split support ring 68 is aligned so that the studs 78 will pass through the through bores 76 and the upper split support ring will rest on the nuts 80. The nuts are then adjusted so that just enough space exists for a top nut 82 to be threaded onto the top end of each stud 78.

In this manner, when the last joint of the casing string 14 is run, the last casing collar 84 will land on the support ring assembly. The load of the casing string 14 will accordingly be transferred through the casing collar 84 to the upper split support ring 68, through the studs 78 to the lower split support ring 66, and finally to the base plate assembly 10. The height of the casing string 14 relative to the base plate assembly 10 may be adjusted by adjusting the position of the nuts 80 on the studs 78.

Figure 5:
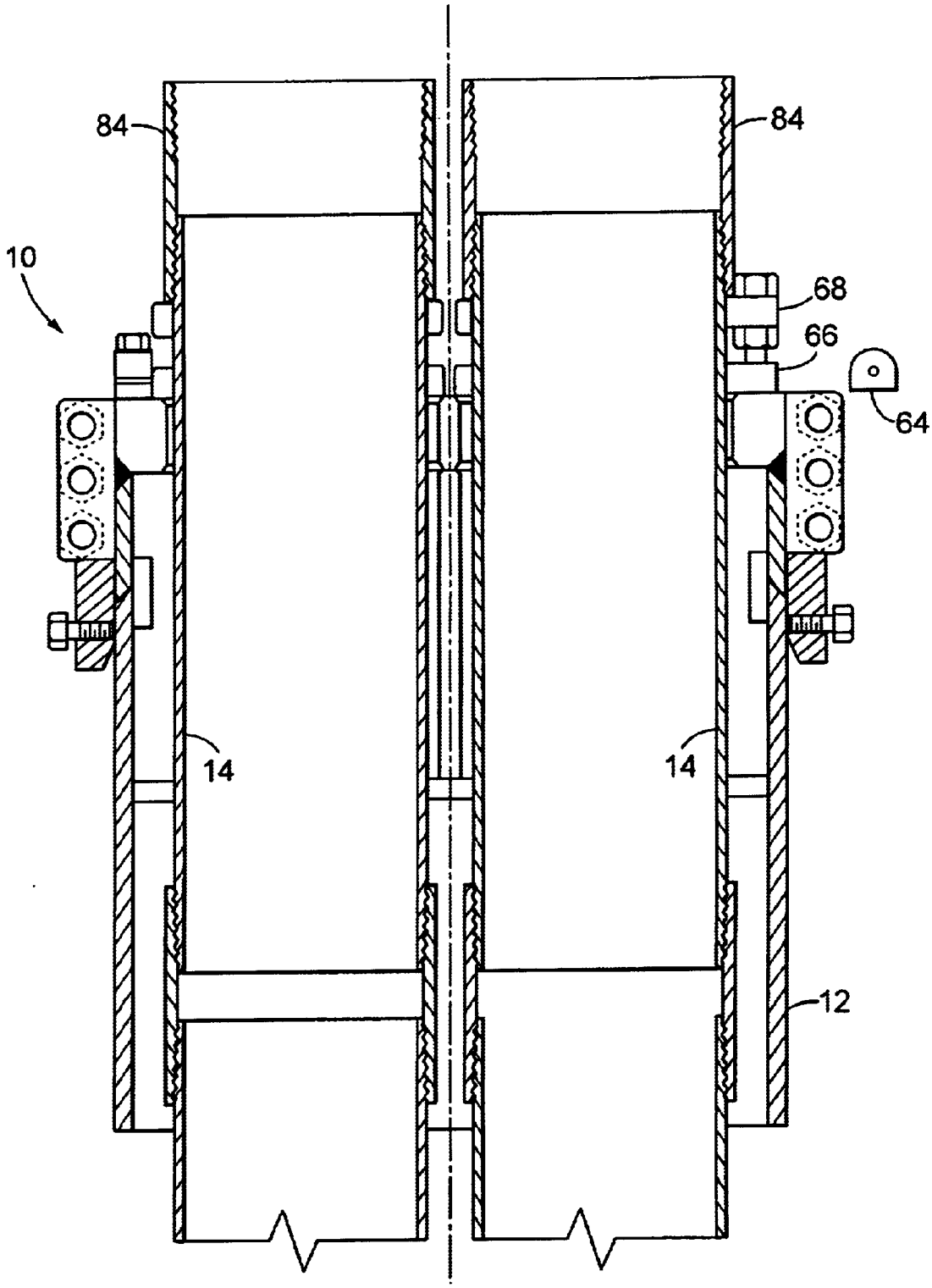
FIG. 5 is a cross sectional view of the base plate assembly of FIG. 3 showing two casing strings supported in the conductor pipe.

This installation procedure is repeated until all of the casing strings 14 are landed in their respective casing bores 24, as shown in FIG. 5. At this point, the casing strings 14 may be cemented in the conductor pipe 12. Referring again to FIGS. 1 and 2, a cementing retention plate 86 is secured around each casing string 14 above the last casing collar 84. The cementing retention plate 86 comprises two half portions 88 and preferably two anchor plates 90 which are secured between the two half portions using bolts 92 or the like. An anchoring mechanism such as a turnbuckle 94 is then used to connect each anchor plate 90 to a corresponding pad eye 64 on the top plates 18. The retention plates 86 and anchoring mechanisms thus prevent the casing strings 14 from raising up during the cementing operation.

After the casing strings 14 have been cemented in place, the base plate assembly 10 may be removed from the conductor pipe 12. This may be accomplished by first loosening the nuts 80 on the support ring assembly to allow the upper split support ring 68 to drop away from the casing collar 84. This removes the load from the lower split support ring 66, and both the upper and lower split support rings can consequently be removed from the casing strings 14. Next, any tack welding between the base plate assembly 10 and the conductor pipe 12 is removed. The bolts 44 securing the alignment blocks 36 to the top plates 18 and the stud and nut assemblies 34 securing the connecting ears 30 together are then removed to allow the base plate portions 16 to separate. Each base plate portion 16 is then lifted until the ribs 52, 54 are clear of the conductor pipe 12. All the components of the base plate assembly 10, including the support ring assembly and the cementing retention plate 86, may then be reused on other wells.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A base plate assembly for supporting a number of tubular strings within a tubular housing, the base plate assembly comprising:

two base plate portions which when secured together are adapted to be supported on an upper end of the tubular housing; and means for releasably securing the base plate portions together;

wherein each base plate portion comprises a top plate which includes an end face and a plurality of semicircular openings that extend from the end face;

wherein when the base plate portions are secured together, the semicircular openings align to form a plurality of circular bores which are each adapted to receive a corresponding tubular string; and wherein the base plate portions may be disconnected and removed from the tubular housing after the tubular strings are secured in the tubular housing.

2. The base plate assembly of claim 1, wherein the securing means comprises at least two bolts which each extend through corresponding holes that are formed in the top plates on opposite sides of the end faces.

3. The base plate assembly of claim 2, wherein the securing means comprises:

two pairs of connecting ears, each pair of which is attached to a corresponding top plate on opposite sides of the end face;

wherein the holes are formed in the connecting ears.

4. The base plate assembly of claim 1, wherein the securing means comprises at least two alignment blocks which are each connected to adjoining portions of the top plates.

5. The base plate assembly of claim 4, wherein the alignment blocks each comprise a trapezoidal recess that is adapted to engage a pair of tapered projections which are formed on the adjoining portions of the top plates.

6. The base plate assembly of claim 1, wherein each base plate portion further comprises a semi-cylindrical pipe section which is attached to the top plate and engages the tubular housing.

7. The base plate assembly of claim 6, wherein each pipe section comprises a lower end which is adapted to land on the upper end of the tubular housing.

8. The base plate assembly of claim 7, wherein the lower end is adapted to mate with the upper end.

9. The base plate assembly of claim 6, wherein each base plate portion further comprises a medial rib which depends from the top plate and extends between the pipe section and a central portion of the end face.

10. The base plate assembly of claim 9, wherein each base plate portion further comprises at least one lateral rib which depends from the top plate and extends between the medial rib and the pipe section.

11. The base plate assembly of claim 1, further comprising means for aligning the base plate assembly on the tubular housing.

12. The base plate assembly of claim 11, wherein the aligning means comprises a plurality of alignment guides which are positioned peripherally around the tubular housing.

13. The base plate assembly of claim 12, wherein the aligning means further comprises a plurality of centralizing bolts which each extend through a threaded hole in a corresponding one of the alignment guides and engage the outer diameter of the tubular housing.

14. The base plate assembly of claim 11, wherein the aligning means comprises a number of centralizing ribs which each engage the inner diameter of the tubular housing.

15. The base plate assembly of claim 6, further comprising a plurality of alignment guides which are positioned peripherally around the tubular housing and attached to the pipe sections.

16. The base plate assembly of claim 15, further comprising a plurality of centralizing bolts which each extend through a threaded hole in a corresponding one of the alignment guides and engage the outer diameter of the tubular housing.

17. The base plate assembly of claim 6, further comprising a number of centralizing ribs which are attached to the inner diameter of the pipe sections and engage the inner diameter of the tubular housing.

18. The base plate assembly of claim 1, further comprising means for supporting each tubular string within a corresponding circular bore.

19. The base plate assembly of claim 18, wherein the supporting means comprises a split support ring which is secured around the tubular string.

20. The base plate assembly of claim 18, wherein the supporting means comprises:

a lower split support ring which is secured around the tubular string and which includes a plurality of threaded blind holes;

an upper split support ring which is secured around the tubular string above the lower split support ring and which includes a plurality of through holes that align with the blind holes;

a number of threaded studs, each of which is received in a corresponding blind hole and extends through a corresponding through hole;

a number of first nuts, each of which is threaded onto a corresponding stud between the lower split support ring and the upper split support ring; and a number of second nuts, each of which is threaded onto a corresponding stud over the upper split support ring;

wherein the lower split support ring is landed in the circular bore and the upper split support ring engages a collar which connects successive sections of the tubular string to thereby support the tubular string on the base plate assembly; and wherein the distance between the upper split support ring and the lower split support ring may be adjusted by adjusting the first nuts.

* * * * *